US010619314B2

(12) United States Patent
Safir et al.

(10) Patent No.: US 10,619,314 B2
(45) Date of Patent: Apr. 14, 2020

(54) APPARATUS FOR IN-PLACE RECYCLING OF MATERIALS FORMING PART OF A ROADWAY PAVEMENT, AND CRUSHER FOR MILLING DEBRIS FROM A ROADWAY PAVEMENT

(71) Applicant: COLAS, Paris (FR)

(72) Inventors: Bouchaïb Safir, Casablanca (MA); Claude Cazal, Libreville (GA); Thierry Le Roch, Vienne (AT)

(73) Assignee: COLAS, Paris (FR)

( * ) Notice: Subject to any disclaimer, the term of this patent is extended or adjusted under 35 U.S.C. 154(b) by 0 days.

(21) Appl. No.: 16/300,252

(22) PCT Filed: May 9, 2017

(86) PCT No.: PCT/FR2017/051106

§ 371 (c)(1),
(2) Date: Nov. 9, 2018

(87) PCT Pub. No.: WO2017/194873

PCT Pub. Date: Nov. 16, 2017

(65) Prior Publication Data

US 2019/0145065 A1 May 16, 2019

(30) Foreign Application Priority Data

May 10, 2016 (FR) ..... 16 54159

(51) Int. Cl.
*E01C 23/00* (2006.01)
*E01C 23/06* (2006.01)
(Continued)

(52) U.S. Cl.
CPC ..... *E01C 23/065* (2013.01); *B02C 18/0084* (2013.01); *B02C 18/142* (2013.01)

(58) Field of Classification Search
CPC .. E01C 23/065; B02C 18/0084; B02C 18/142
(Continued)

(56) References Cited

U.S. PATENT DOCUMENTS 3,596,577 A * 8/1971 Chennells ..... E01C 21/00 404/90
3,843,274 A * 10/1974 Gutman ..... B62D 55/084 404/91
(Continued)

FOREIGN PATENT DOCUMENTS

DE 112008001749 8/2010
EP 0324491 7/1989
(Continued)

OTHER PUBLICATIONS

International Search Report, PCT/FR2017/051106, dated Oct. 12, 2017.

*Primary Examiner* — Raymond W Addie
(74) *Attorney, Agent, or Firm* — Young & Thompson

(57) ABSTRACT

An apparatus for in-place recycling of materials that form part of a roadway pavement with agglomerated aggregates in a bituminous composition, includes a load-bearing structure suitable for driving on the pavement in a direction of travel and carries, from the front to the rear in the direction of travel, a transverse milling machine for milling the pavement to a defined depth and width to produce milling debris, a mixing device for mixing the milling debris with a binding composition, and a spreading sub-assembly for distributing the milling debris/binding composition mixture across the milled pavement. The apparatus further includes a crusher with blades, between the milling machine and the mixing device, open on the bottom, for crushing the milling debris. In one embodiment, the crusher and the mixing device are located in a single unit. The application also
(Continued)

Figure 4:
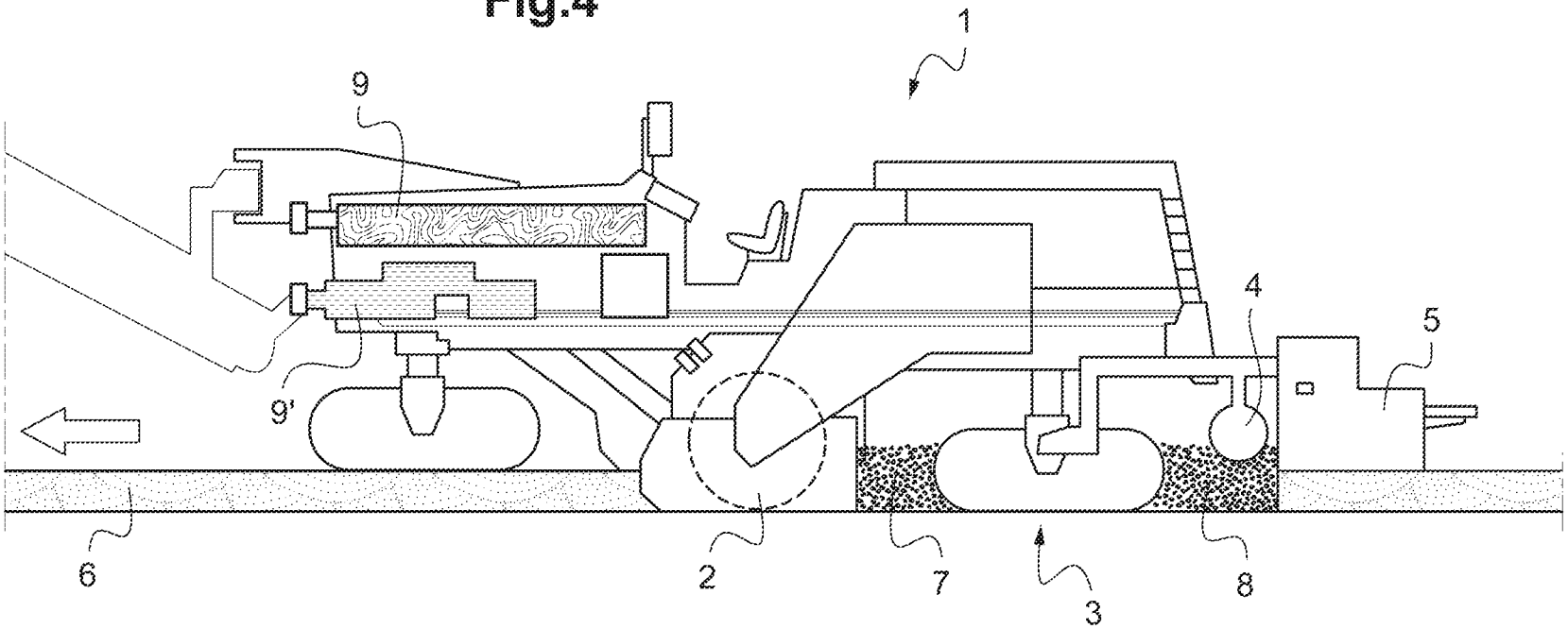

relates to a crusher for milling debris from roadway pavements.

20 Claims, 2 Drawing Sheets

(51) Int. Cl.
*B02C 18/00* (2006.01)
*B02C 18/14* (2006.01)

(58) Field of Classification Search
USPC ..... 404/90–95
See application file for complete search history.

(56) References Cited

U.S. PATENT DOCUMENTS 4,011,023 A 3/1977 Cutler
4,072,735 A * 2/1978 Ardemagni ..... C09J 123/20 525/177
4,272,212 A * 6/1981 Bauer, Jr. ..... E01C 7/187 106/283
4,317,642 A * 3/1982 Wirtgen ..... E01C 23/065 404/72
4,453,856 A 6/1984 Chiostri et al.
4,637,753 A 1/1987 Swisher, Jr.
4,676,688 A * 6/1987 Caradot ..... E01C 19/466 198/308.1
4,708,294 A * 11/1987 Endom ..... A01B 33/021 241/27
7,004,675 B2 * 2/2006 Wayne ..... E01C 23/065 299/39.6
2005/0084330 A1 * 4/2005 Grubba ..... E01C 19/187 404/84.1

FOREIGN PATENT DOCUMENTS

WO WO 90/10752 9/1990
WO WO 91/02846 3/1991
WO WO 96/26319 8/1996
WO WO 2010/017283 2/2010

* cited by examiner

Fig.1
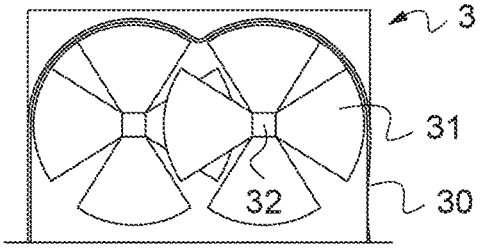
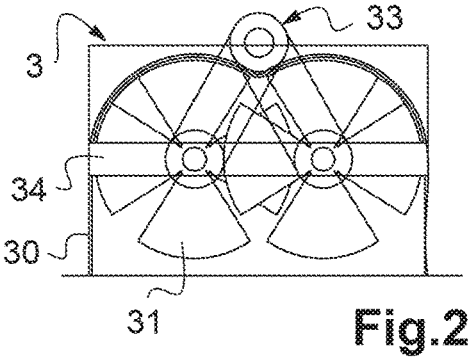
Fig.2
Fig.3
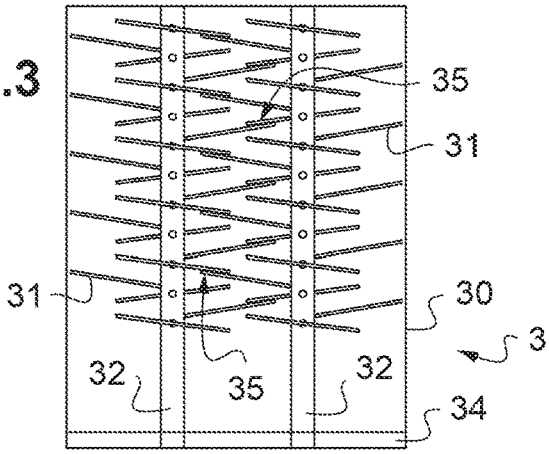
Fig.5
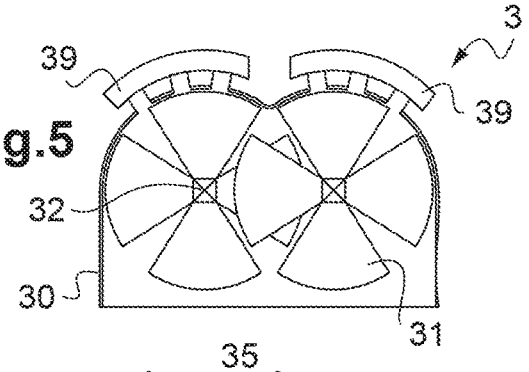
Fig.6
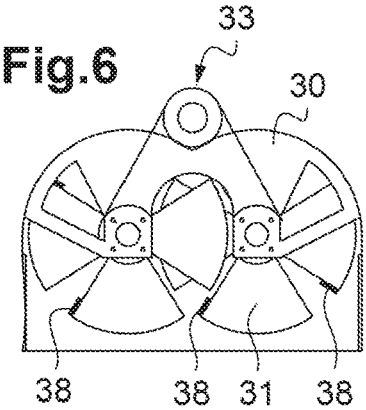
Fig.7
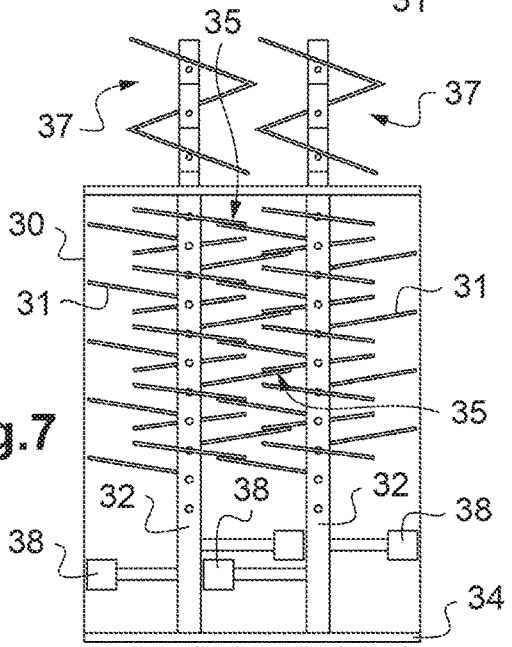
Fig.8
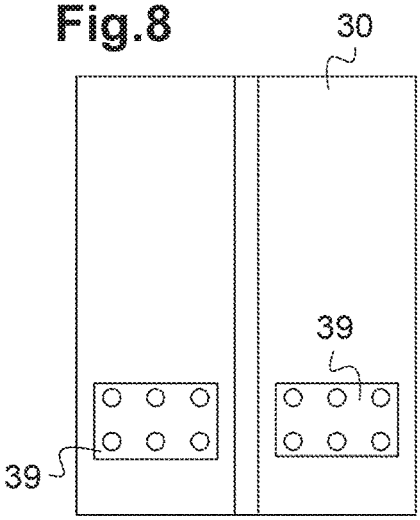

APPARATUS FOR IN-PLACE RECYCLING OF MATERIALS FORMING PART OF A ROADWAY PAVEMENT, AND CRUSHER FOR MILLING DEBRIS FROM A ROADWAY PAVEMENT

TECHNICAL FIELD TO WHICH THE INVENTION RELATES

The present invention generally relates to the field of maintenance of road pavements including vehicle traffic lanes. More particularly, it relates to an apparatus for in-place recycling of materials constituting a road pavement as well as a specially adapted crusher.

TECHNOLOGICAL BACK-GROUND

The pavements stressed by the circulating vehicles and the environment, in particular the weather variations, become degraded and hence finally need to be renewed. Generally, these pavements include materials of the aggregate and bitumen type. It is particularly interesting that these materials could be reused for repairing the pavement. That is why it has been proposed, in adapted machines, to reuse these materials after they have been extracted from the pavement, by mixing them in mixing chambers with an added bituminous binder et then spreading them over the pavement from which they have been extracted. On that matter, the following documents may for example be mentioned: U.S. Pat. Nos. 4,453,856A, 4,011,023, DE112008001749T5 or WO96/26319. However, the extraction of the materials from the pavement, in particular by milling, does not allow controlling the size of the particles extracted from the pavement. Means have hence been proposed to better control this size, for example in U.S. Pat. Nos. 4,637,753A, 3,843,274A and WO91/02846. WO90/10752A1, EP0324491A1, WO2010/017283A2 and EP0158560A1 are also known. However, the solutions proposed are difficult to implement and use in particular due to the use of closed chambers whose access is difficult.

OBJECT OF THE INVENTION

In order to remedy the above-mentioned drawback of the state of the art, the present invention proposes to use a crusher whose chamber is open towards the bottom and the pavement and implementing simple crushing tools consisted of blades of simple shape, that are rotationally driven. It allows the making of a pavement processing machine able to perform all the operations, from the pavement milling to the spreading over the milled pavement of the reprocessed materials, and comprising a crushing and possibly the addition of a binder using a ramp integrated to the crushing apparatus, and a possible mixing of the materials directly within the crushing apparatus.

It is proposed an apparatus for the in-place recycling of materials constituting a road pavement, said pavement including aggregates agglomerated in a bituminous composition, said apparatus including a load-bearing structure adapted to circulate on said pavement, along the latter in a direction of travel, and carrying, from upstream to downstream in the direction of travel, a transverse milling machine for disintegrating the pavement over determined height and depth and producing milling debris, a mixer for mixing the milling debris with a binding composition, and a sub-assembly for distributing the milling debris mixed with the binding composition over the width of the milled pavement, and the apparatus further includes, between the milling machine and the mixer, a bladed crusher for crushing the milling debris. This apparatus may also include, in the crusher, a paddle system for mixing the crushed milling debris, after addition of a binder.

More precisely, it is proposed according to the invention an apparatus according to claim 1.

Other non-limitative and advantageous characteristics of the apparatus according to the invention, taken individually or according to any technically possible combinations, are the following:

- the binding composition includes bitumen,
- the binding composition includes asphalt,
- the binding composition bitumen and asphalt,
- the bladed crusher includes at least two longitudinal rotors parallel to each other and arranged in a casing, the rotors being substantially parallel to the pavement, said casing being closed at its two longitudinal lateral sides and its upper face, said casing being open towards the bottom, i.e. on the pavement side, and at its two upstream, milling machine side, and downstream ends, each of the rotors including a set of blades arranged radially around the rotor, each blade being a planar plate of determined thickness and in the shape of a circular sector with the tip towards the rotor, the blades of each rotor sweeping, during their simultaneous rotation, a tubular sweeping space coaxial to the rotor, the tubular sweeping spaces of adjacent rotors interpenetrating each other in an interpenetration area, the blades of adjacent rotors being configured so as to create, in the interpenetration area between pairs of two adjacent blades parallel and the closest to each other of the two adjacent rotors, and coming opposite to each other during their rotation, a spacing of determined size between said two parallel adjacent blades of the pair,
- the blades are arranged in planes perpendicular to the longitudinal axes of the rotors, all the blades of the rotors being in planes parallels to each other.
- the blades are subdivided into two groups according to the orientation thereof, the blades of a first group being arranged in planes parallel to each other and the blades of a second group being arranged in planes parallel to each other, the planes of the first and second groups being not parallel between each other and not perpendicular to the longitudinal axes of the rotors,
- the planes of the first and second groups are symmetrically inclined between each other with respect to the longitudinal axes of the rotors,
- the planes of the first and second groups are parallel to an axis perpendicular to the longitudinal axis of a rotor, preferably said axis perpendicular to the longitudinal axis of the rotor being vertical, considering that the longitudinal axis of the rotors are horizontal,
- the planes of the first and second groups are vertical, considering that the longitudinal axis of the rotors are horizontal,
- each of the rotors includes a set of units with blades, each bladed unit including a determined number of blades, the blades of a bladed unit being arranged on a bladed unit hub, said hub mounted on the rotor being rotated by said rotor, said hubs being separated from each other along the rotor by spacers, each being of determined length,
- the rotors have a square cross-section, the hubs have a central orifice of complementary square cross-section and the hubs can slide along their respective rotors when they are no longer stressed by the spacers, at least one part of the spacers being interchangeable between spacers of different lengths so that the spacing between said two parallel adjacent blades of the pair can be selected, the hub further includes a means for its clamping to the rotor, preventing its sliding along the rotor, said clamping means having to be released to allow the sliding of the hub along the rotor, the spacers are omitted, the positioning of the hubs along the rotors being provided by the clamping means thereof, the clamping means being preferably indexed into position along the rotor, said rotor including notches or feedthroughs receiving the clamping means, the spacers are rings openable into two parts, the closing of the two ring parts about the rotor being held by at least one nut-and-bolt unit passing through said two parts at the periphery of the ring, without having to pass through the rotor, the spacers are rings openable into two parts, the closing of the two ring parts about the rotor being held by at least one nut-and-bolt unit passing radially through said two parts and transversally through the rotor, the casing includes, between the upstream end and the downstream end of the crusher, at least one orifice for introduction of the binding composition, the part of the crusher downstream from said at least one introduction orifice providing a mixing of the crushed milling debris with the biding composition to form the mixer, the crusher and the mixer being located in a single and same element, the crusher having, in its downstream part, a mixing or crushing +mixing function, the crusher part downstream from said at least one introduction orifice providing the mixing of the crushed milling debris with the binding composition fulfils only a mixing function, for example in particular due to the fact that the determined spacings between said two parallel adjacent blades of the pairs are different between the upstream and the downstream, said determined spacing being of greater size downstream, the downstream part of the crusher providing the mixing of the crushed milling debris with the binding composition includes mixing paddles rotated by the rotors, the crusher part downstream of said at least one introduction orifice providing the mixing of the crushed milling debris with the binding composition fulfils a double function of crushing and mixing, the spacing between said two parallel adjacent blades of the pair is constant along rotors between the upstream end and the downstream end of the crusher, the spacing between said two parallel adjacent blades of the pair varies along the rotors between the upstream end and the downstream end of the crusher, the spacing between said two parallel adjacent blades of the pair is different between the upstream crushing end and the downstream crushing and mixing end of the crusher, the bladed crusher includes two rotors rotating in the same direction, in a variant, the bladed crusher includes two rotors rotating in opposite directions, the rotations of the blades preferably occurring upward in the interpenetration area, the rotations occur downward in the interpenetration area between the pairs of two adjacent blades, the determined thickness of the planar plates forming the blades is comprised between 10 mm and 50 mm, and the lateral edges of the plates are planar and perpendicular to the general plane of the planar plate, the determined spacing between the two parallel adjacent blades of a pair is chosen between 5 mm and 30 mm, the lateral edges of the plates are curved over their height, the lateral edges of the plates are bevelled along the thickness of the plate, the lateral edges of the plates are provided with teeth, the arc-shaped, free radial edge of the plates is flat in the plate thickness direction and perpendicular to the general plane of the planar plate, the arc-shaped, free radial edge of the plates is bevelled along the plate thickness, the arc-shaped, free radial edge of the plates is provided with teeth, the upper part of the casing conforms the shapes of the tubular sweeping spaces.

The invention also proposes a crusher for milling debris from a road pavement, said pavement including aggregates agglomerated in a bituminous composition and having been milled. The crusher is specially configured for the apparatus of the invention and includes blades and at least two longitudinal rotors parallel to each other and arranged in a casing, the rotors being substantially parallel to the pavement, said casing being closed at its two longitudinal lateral sides and its upper face, said casing being open towards the bottom, i.e. on the pavement side, and at its two upstream and downstream ends, each of the rotors including a set of blades arranged radially around the rotor, each blade being a planar plate of determined thickness and in the shape of a circular sector with the tip towards the rotor, the blades of each rotor sweeping, during their simultaneous rotation, a tubular sweeping space coaxial to the rotor, the tubular sweeping spaces of adjacent rotors interpenetrating each other in an interpenetration area, the blades of adjacent rotors being configured so as to create in the interpenetration area between pairs of two adjacent blades parallel and the closest to each other of two adjacent rotors, and coming opposite to each other during their rotation, a determined spacing between said two parallel adjacent blades of the pair.

The invention also relates to an automotive machine for the in-place recycling of materials constituting a road pavement, said pavement including aggregates agglomerated in a bituminous composition, said machine including, in the direction of travel, from upstream to downstream longitudinally, a transverse milling machine for disintegrating the pavement over determined height and depth and producing milling debris, a mixer for mixing the milling debris with a binding composition, and a sub-assembly for distributing the milling debris mixed with the binding composition over the width of the milled pavement, said machine further including, between the milling machine and the mixer, a bladed crusher for crushing the milling debris between the blades.

The machine further includes one or several of the described material means of the apparatus.

DETAILED DESCRIPTION OF AN EXEMPLARY EMBODIMENT

The following description in relation with the appended drawings, given by way of non-limitative example, will allow a good understanding of what the invention consists in and of how it can be implemented.

In the appended drawings:

FIG. 1 shows an example of crusher, viewed from the front, from its front/upstream end, FIG. 2 shows this same crusher, viewed from the rear, from its rear/downstream end, FIG. 3 shows this same crusher, viewed from below, FIG. 4 shows a pavement processing machine with material recycling and crusher, and FIGS. 5 to 8 show another example of crusher, including this time, a mixing function on the downstream side, and worms at the front of its casing, in cross-sectional view at the level of the binder injection nozzles, in rear/downstream view, in bottom view and in top view, respectively.

APPARATUS

The pavement processing machine 1 with material recycling shown by way of example in FIG. 4 includes means for rolling on the ground, herein a pavement 6, those means being typically tracked means, a motor and control means for controlling, in particular, the steering, the running speed adjustment and the various elements from which it is made-up. It further includes means for storing the materials 9, 9' needed for its operation, the combustible, and also for example aggregates or new asphalt and, possibly, bitumen/emulsion 9. In FIG. 4, only the supply of bitumen/emulsion 9 and of water 9' is shown, the latter serving in particular for cooling the rotor of the milling machine 2. Some of these storage means may be of the buffer type, that is to say they are regularly refilled during the operation of the machine, without having to stop the machine.

Among the elements of the machine, we find, in the longitudinal direction, from the front/upstream in the direction of travel of the machine moving forward, a milling machine 2 producing milling debris 7, followed with a crusher 3, followed with a mixer, then with a worm distributing machine 4. The milling machine is operable to extract the materials from the pavement over determined height and width of this pavement, this element being transverse, i.e. perpendicular to the main longitudinal (antero-posterior) extent of the machine. The milling machine that produces milling debris 7 may be a toothed milling machine or a machine of another type.

The crusher 3, located downstream from the milling machine, is operable to break the cohesion of the milling debris and to crush them and produces crushed milling debris, which are possibly mixed 8 if the mixing function has been provided in the crusher. In the latter case, the crusher and the mixer are a single and same element.

The crusher 3, arranged under the machine, is herein made-up by a casing 30 open towards the bottom and hence the milled pavement. The casing is also open at its two front/upstream and rear/downstream ends to, respectively, receive the raw milling debris produced by the milling machine (front/upstream inlet) and deliver the crushed milling debris (rear/downstream outlet) once these latter crushed. Indeed, the milling debris received, crushed and delivered by the milling machine are on the ground and the machine moves on this ground in such a manner that a relative displacement exists between the milling debris on the ground and the crusher attached under the machine. The crusher has no isolated crushing chamber above the ground, the milling debris remaining essentially on the ground. Preferably, the width (transverse measurement on the machine) of the crusher corresponding to the width of the casing inlet (front/upstream end) is substantially equal to the length (transverse measurement on the machine and corresponding to the width of the milled pavement) of the milling machine so that all the produced milling debris are directly swallowed by the crusher. In the case where the milling machine would be longer than the crusher width, a passive chute or an active means, for example rotational brushes or other, arranged at the level of the ground, is operable to collect all the milling debris over the milling width to guide them to the front/upstream inlet of the crusher.

The crusher casing includes internally two parallel rotors 32 elongated in the longitudinal direction of the machine. The two rotors 32 are substantially parallel to the longitudinal extent of the pavement and they radially include metal blades 31. The rotors are rotated by a motor element 33, typically hydraulic. The driving of the rotors uses in this example a chain whose links mesh with toothed pulleys of the rotors and of the motor element. The casing, the rotors and the motor element are carried by a frame (partially symbolized/shown by the stud 34 in FIGS. 1 to 3) attached under the machine. Bearings, in particular rolling bearings, are implemented between the mobile and fixed parts of the crusher. Each rotor includes, attached on its periphery, blades that, in this example, are identical in shape and size. The shape represented is a segment of circle, i.e. a circular sector, whose tip/apex is towards the rotor. This segment/sector has a tip/apex angle comprised between 90° and 10° and it is of about 80° in the Figures. The blades are hence terminated by an arc at their free end opposite to their tip/apex attached to the rotor. The rotation of the rotor drives the blades that hence sweep a tubular sweeping space when seen according to the axis of rotation of the rotors. The two rotors and the blades are arranged in the casing so that the two tubular sweeping spaces interpenetrate each other in an interpenetration area, in which blades of the two rotors located in planes parallel to each other will come two-by-two, by pair 35, opposite to each other at a short distance, a free spacing/space of determined size being then present between the two concerned blades 35. It is understood that, due to the rotation of the blades, this spacing of determined size will be temporary and will evolve for the concerned opposite surfaces of the blades and it will be repeated at different moments and different places for different pairs of blades 35, the two blades of a concerned pair being from the two rotors.

The value of this spacing size is one of the main parameters making it possible to modify the particle size of the crushed milling debris. For example, with a determined spacing between the two opposite blades of the pair of about 15 mm, crushed milling debris having a homogeneous and continuous particle size, with a controlled dmax between 10 and 14 mm, can be obtained. These values are indicative and can be modified as needed.

It is understood that, due to the rotation of the two rotors, different pairs of parallel blades of the rotors come opposite to each other, at a short distance/spacing, at different moments. The milling debris are crushed/ground mainly by the impact of the lateral edges of the blades, and by the small spacing between the pairs of blades that come opposite to each other with a shearing effect when the two blades of the pair begin to come opposite to each other. Due to this shearing effect, bevels and/or teeth can be created on the lateral edges of the blades just like shears or scissors, but, contrary to these latter, as the blades of the pair remain separated from each other by the indicated spacing when they come opposite to each other: there is no friction between the blades of the two rotors.

In an alternative embodiment, the arc-shaped, free edge of each blade includes a bevelled/tapered part as well as, possibly, the top/adjacent part of the lateral edge(s). Thanks to that, it is possible to lower the crusher as much as possible, so that the blades come flush with the surface of the milled pavement, or even slightly nibble it, without creating a too high resistance to the rotation of the rotors due to the fact that this is a weak surface (the bevel end) that comes and hits the surface of the milled pavement. Hence, in the lowest possible position of the crusher, even without nibbling, in case a bump present on the surface of the milled pavement is met, there will be less risk of rotation blocking. Preferably, for the sake of safety, in the crusher, an overload/blocking sensor may be implemented on the motor element or a friction or fracture clutch is installed on the transmission towards the rotors.

By way of additional safety, in particular against metal elements which might have been covered with the pavement materials, for example valve box heads, a metal sensor may be provided on the front of the machine or of the crusher. Moreover, a minimum spacing of the blades may be provided along each rotor, apart from what occurs in the interpenetration area in which the described determined spacing must exist for each pair of blades, this minimum spacing corresponding to the mean diameter of the metal elements that may be met in a pavement so that these elements can preferably pass through the blades once extracted. Finally, sharp elements may be provided, for example on the rotors or protruding from these latter, that are intended to cut wires, for example from in-pavement detection loop, that would come and wrap around the rotors.

The blades may be arranged on the rotors in various ways from the moment that the crushing occurs, in particular thanks to the shearing effect of the two blades of the pair of two rotors that come opposite to each other in the interpenetration area. Preferably, this is obtained with blades that are planar metal plates and that are parallel to each other for those of the pairs coming opposite to each other with a short determined spacing between them in the interpenetration area. Simply, this result can be obtained with blades that are all in planes parallel to each other and perpendicular to the rotors that, as reminded, are parallel to each other. Considering that the machine is horizontal on a horizontal pavement, the rotors are then horizontal and longitudinally elongated, and the blades are in transverse vertical planes. Another solution corresponds to the case in which the blades are subdivided into two groups as regards their orientations. Within each group, the blades are in planes that are parallel to each other. Each rotor includes blades from the two groups and the pairs of blades coming opposite to each other and with the described spacing belong to the same group, wherein, in a pair, one of the blades is on one of the rotors and the other blade is on the other rotor. The planes carrying the blades are no longer perpendicular to the axes of the rotors but inclined with respect to this axis. Preferably, the inclinations are symmetrical between the two groups. It is to be noted that, in the example shown in the Figures, the blades are all in vertical planes, considering that the rotors are horizontal. It is understood that other arrangements of planar plates forming the blades are possible to obtain this same result of milling debris crushing with creation of a determined spacing between pairs of blades coming opposite to each other in the interpretation area.

It is reminded that the machine moves forward during the processing of the pavement and, that way, the milling debris that are on the ground and that are crushed by the crusher do not need to be actively pushed rearward/downstream. However, it may be provided that a particular orientation of the blades, non-perpendicular to the rotors, can further provide a certain active transportation rearward/downstream of the milling debris that have been crushed, then possibly mixed if a mixing is also provided.

The casing of the crusher is open downward and hence toward the pavement, as well as on the front/upward and the rear/downward for the passage of the milling debris through the inlet then the outlet of the crusher. On the other hand, the casing encloses the rotors and their blades laterally and on the top. On the top, the casing conforms the shape of the two tubular sweeping spaces. This casing avoids the projections of the aggregates and milling debris and participate to the crushing of the milling debris and possibly to the mixing if the latter is provided.

In order for the machine to be able to perform the complete treatment of the pavement, a mixer is also implemented within the machine. This mixer allows mixing the milling debris having undergone the crushing with a bituminous binding and/or a certain proportion of aggregates or event "new" asphalt, in order to regenerate certain properties of the pavement. This mixer may be independent from the crusher but, as an alternative, it may be integrated to the crusher. For that purpose and as shown in FIGS. 5 and 8, the rear/downstream part of the crusher includes at least one orifice for introduction of these additional products. Preferably, the structure of the blades is modified in this rear/downstream part of the crusher, for example with different shape and/or orientation of the blades and/or a spacing/free space of higher size between the blades of the pairs coming opposite to each other with respect to the orientation and/or the spacing on the front/upstream, where the crushing must be predominant. In particular, as shown in FIG. 7, paddles 38 are installed in the rear/downstream part of the crusher to provide an efficient mixing of the crushed milling debris, on which a binder has been spread by a set of nozzles 39. That way, it is possible to control, in this rear/downstream part of the crusher, the presence of a mixing effect in addition to a crushing effect, and the importance of the crushing effect with respect to the mixing or, also, to obtain a mixing effect alone, i.e. without crushing effect.

It can be seen in FIG. 7 an additional element on the front of the crusher 3 and out of its casing 30. This additional element is a means for actively driving the milling debris produced by the milling machine, which is located even farther on the front of the crusher 3, the active driving occurring towards the inside of the casing 30 of the crusher 3. This active driving means is consisted by two worms mounted on two anterior extensions of the rotors 32, on the front of the casing 30. This active driving means may be omitted or made removable so that it can be installed only for processed pavements for which the milling debris could have difficulty to pass through the crusher casing despite the moving forward of the machine that processes the pavement. In particular, this active driving means is particularly useful if a binder has also been introduced upstream of the crushing, at the milling machine.

The speed of rotation of the crusher blades must be relatively high, and in any case, higher than that which is conventionally met in mixing means. Typically, the speed of rotation of the rotors may be comprised between 120 and 220 rpm and is preferably of about 160 rpm.

We can hence understand the possible interest to provide a structure that is different from the crusher in its rear/downstream mixing part with respect to its front part of pure crushing. As seen, this different structure may concern the shape of the blades and above all their spacing when they are opposite and close to each other in the interpenetration area or even providing that there is no longer or almost no longer interpenetration area in this rear/downstream part.

On the rear of the machine, a sub-assembly 4 for the distribution of the milling debris 8 mixed by the mixing machine with the additional products 9 is operable to spread them over the width of the milled pavement. This distribution sub-assembly is typically of the transverse worm type. Moreover, a positioning and pre-compaction table 5 may be comprised in the distribution sub-assembly. In an embodiment, this distribution sub-assembly is connected to the machine at the worksite, this distribution sub-assembly being disassembled for the transportation between worksites. In a variant, the distribution sub-assembly is a part of the machine.

By way of example of possible sizes for a crusher according to the invention, the crusher width (transverse measurement on the casing) may be of about 1.16 m with a spacing of the two rotors of about 0.43 m and the crusher length (longitudinal measurement between its upstream/front inlet and its downstream/rear outlet) of about 1.5 m and the crusher height (maximum vertical measurement on the casing) may be of about 0.5 m.

A machine integrating the crusher and the mixer has just been described. However, the invention may be implemented with a machine that performs only a simple milling and, at the rear thereof, is added a towed equipment including the crusher and possibly the mixer and, preferably, the distribution sub-assembly and potentially the positioning and pre-compaction table. In an equivalent way, the equipment towed by the simple milling machine is only the crusher and, on the other hand, the mixer and other downstream pieces of equipment are another autonomous machine with a positioning and pre-compaction table that circulates autonomously from the simple milling machine that is located upstream. In another equivalent way, the equipment towed by the simple milling machine is only the crusher with its integrated mixer and, on the other hand, the other downstream pieces of equipment are another autonomous machine with a positioning and pre-compaction table that circulates autonomously from the simple milling machine that is located upstream. It is understood that other equivalent arrangements are possible to implement the crusher according to the invention and the potential mixer integrated therein.

Method

The method of the invention ensues from the above description now with the implementation of a machine with which are performed a milling of the pavement, then a crushing of the milling debris, then a mixing of the crushed milling debris with additional products, then a distribution of the obtained materials over the pavement, the crushing and the mixing occurring in the same element of the machine. These additional products are typically a bituminous binder and/or aggregates or even asphalt.

The invention claimed is:

1. An apparatus (1) for the in-place recycling of materials constituting a road pavement, said pavement (6) including aggregates agglomerated in a bituminous composition, said apparatus comprising:

a load-bearing structure adapted to circulate on said pavement, along the latter in a direction of travel, and carrying, from upstream to downstream in the direction of travel, a transverse milling machine (2) for disintegrating the pavement over determined height and depth and producing milling debris (7), a mixer for mixing the milling debris with a binding composition (9), and a sub-assembly for distributing (4) the milling debris mixed (8) with the binding composition over the width of the milled pavement, and a crusher (3) with blades (31) intended to crush on the ground the milling debris before the mixing of the milling debris with the binding composition, wherein the crusher (3) with blades (31) includes at least two longitudinal rotors (32) parallel to each other and arranged in a casing (30), the rotors (32) being substantially parallel to the pavement (6), said casing (30) being closed at its two longitudinal lateral sides and its upper face, said casing being open towards the bottom, directly on the pavement, and open at its two upstream, milling machine side, and downstream longitudinal ends, each of the rotors (32) including a set of blades (31) arranged radially around the rotor (32) and wherein each blade (31) is a planar plate of determined thickness and in the shape of a circle sector with the tip towards the rotor.

2. The apparatus according to claim 1, wherein the blades of each rotor sweep, during their simultaneous rotation, a tubular sweeping space coaxial to the rotor, the tubular sweeping spaces of adjacent rotors interpenetrating each other in an interpenetration area, the blades of adjacent rotors being configured so as to create, in the interpenetration area between pairs of two adjacent blades parallel and the closest to each other of the two adjacent rotors, and coming opposite to each other during their rotation, a spacing of determined size between said two parallel adjacent blades of the pair.

3. The apparatus according to claim 2, wherein the blades (31) are arranged in planes perpendicular to the longitudinal axes of the rotors (32), all the blades of the rotors being in planes parallels to each other.

4. The apparatus according to claim 2, wherein the blades (31) are subdivided into two groups according to the orientation thereof, the blades of a first group being arranged in planes parallel to each other and the blades of a second group being arranged in planes parallel to each other, the planes of the first and second groups being not parallel between each other and not perpendicular to the longitudinal axes of the rotors (32).

5. The apparatus according to claim 2, wherein each of the rotors (32) includes a set of units with blades (31), each bladed unit including a determined number of blades (31), the blades (31) of a bladed unit being arranged on a bladed unit hub, said hub mounted on the rotor being rotated by said rotor, said hubs being separated from each other along the rotor by spacers, each being of determined length.

6. The apparatus according to claim 5, wherein the rotors (32) have a square cross-section, the hubs have a central orifice of complementary square cross-section and wherein the hubs can slide along their respective rotors when they are no longer stressed by the spacers, at least one part of the spacers being interchangeable between spacers of different lengths so that the spacing between said two parallel adjacent blades of the pair can be selected.

7. The apparatus according to claim 2, wherein the casing (30) includes, between the upstream end and the downstream end of the crusher, at least one orifice for introduction of the binding composition (9), the part of the crusher downstream from said at least one introduction orifice providing a mixing of the crushed milling debris with the biding composition (9) to form the mixer, the crusher and the mixer being located in a single and same element.

8. The apparatus according to claim 2, wherein the crusher (3) with blades (31) includes two rotors (32) rotating in opposite directions, and wherein the determined thickness of the planar plates forming the blades is comprised between 10 mm and 50 mm, and the lateral edges of the plates are planar and perpendicular to the general plane of the planar plate, and wherein the determined spacing between the two parallel adjacent blades of a pair is chosen between 5 mm and 30 mm.

9. The apparatus according to claim 2, wherein the upper part of the crusher (30) conforms the shapes of the tubular sweeping spaces.

10. The apparatus according to claim 3, wherein each of the rotors (32) includes a set of units with blades (31), each bladed unit including a determined number of blades (31), the blades (31) of a bladed unit being arranged on a bladed unit hub, said hub mounted on the rotor being rotated by said rotor, said hubs being separated from each other along the rotor by spacers, each being of determined length.

11. The apparatus according to claim 4, wherein each of the rotors (32) includes a set of units with blades (31), each bladed unit including a determined number of blades (31), the blades (31) of a bladed unit being arranged on a bladed unit hub, said hub mounted on the rotor being rotated by said rotor, said hubs being separated from each other along the rotor by spacers, each being of determined length.

12. The apparatus according to claim 3, wherein the casing (30) includes, between the upstream end and the downstream end of the crusher, at least one orifice for introduction of the binding composition (9), the part of the crusher downstream from said at least one introduction orifice providing a mixing of the crushed milling debris with the biding composition (9) to form the mixer, the crusher and the mixer being located in a single and same element.

13. The apparatus according to claim 4, wherein the casing (30) includes, between the upstream end and the downstream end of the crusher, at least one orifice for introduction of the binding composition (9), the part of the crusher downstream from said at least one introduction orifice providing a mixing of the crushed milling debris with the biding composition (9) to form the mixer, the crusher and the mixer being located in a single and same element.

14. The apparatus according to claim 5, wherein the casing (30) includes, between the upstream end and the downstream end of the crusher, at least one orifice for introduction of the binding composition (9), the part of the crusher downstream from said at least one introduction orifice providing a mixing of the crushed milling debris with the biding composition (9) to form the mixer, the crusher and the mixer being located in a single and same element.

15. The apparatus according to claim 6, wherein the casing (30) includes, between the upstream end and the downstream end of the crusher, at least one orifice for introduction of the binding composition (9), the part of the crusher downstream from said at least one introduction orifice providing a mixing of the crushed milling debris with the biding composition (9) to form the mixer, the crusher and the mixer being located in a single and same element.

16. The apparatus according to claim 3, wherein the crusher (3) with blades (31) includes two rotors (32) rotating in opposite directions, and wherein the determined thickness of the planar plates forming the blades is comprised between 10 mm and 50 mm, and the lateral edges of the plates are planar and perpendicular to the general plane of the planar plate, and wherein the determined spacing between the two parallel adjacent blades of a pair is chosen between 5 mm and 30 mm.

17. The apparatus according to claim 4, wherein the crusher (3) with blades (31) includes two rotors (32) rotating in opposite directions, and wherein the determined thickness of the planar plates forming the blades is comprised between 10 mm and 50 mm, and the lateral edges of the plates are planar and perpendicular to the general plane of the planar plate, and wherein the determined spacing between the two parallel adjacent blades of a pair is chosen between 5 mm and 30 mm.

18. The apparatus according to claim 5, wherein the crusher (3) with blades (31) includes two rotors (32) rotating in opposite directions, and wherein the determined thickness of the planar plates forming the blades is comprised between 10 mm and 50 mm, and the lateral edges of the plates are planar and perpendicular to the general plane of the planar plate, and wherein the determined spacing between the two parallel adjacent blades of a pair is chosen between 5 mm and 30 mm.

19. The apparatus according to claim 6, wherein the crusher (3) with blades (31) includes two rotors (32) rotating in opposite directions, and wherein the determined thickness of the planar plates forming the blades is comprised between 10 mm and 50 mm, and the lateral edges of the plates are planar and perpendicular to the general plane of the planar plate, and wherein the determined spacing between the two parallel adjacent blades of a pair is chosen between 5 mm and 30 mm.

20. A crusher (3) for milling debris (7) from a road pavement (6), said pavement including aggregates agglomerated in a bituminous composition, further comprising blades (31) and at least two longitudinal rotors (32) parallel to each other and arranged in a casing (30), the rotors (32) being substantially parallel to the pavement, said casing (30) being closed at its two longitudinal lateral sides and its upper face, said casing (30) being open towards the bottom, directly on the pavement (6), and at its two upstream and downstream ends, each of the rotors (32) including a set of blades (31) arranged radially around the rotor, each blade being a planar plate of determined thickness and in the shape of a circle sector with the tip towards the rotor, the blades of each rotor sweeping, during their simultaneous rotation, a tubular sweeping space coaxial to the rotor, the tubular sweeping spaces of adjacent rotors interpenetrating each other in an interpenetration area, the blades of adjacent rotors being configured so as to create in the interpenetration area between pairs of two adjacent blades parallel and the closest to each other of the two adjacent rotors, and coming opposite to each other during their rotation, a determined spacing between said two parallel adjacent blades of the pair.

* * * * *